US005547406A

United States Patent [19]

White

[11] Patent Number: 5,547,406

[45] Date of Patent: Aug. 20, 1996

[54] FLOATATION DEVICE WITH PROPELLER AND RUDDER DRIVEN BY A BICYCLE

[76] Inventor: Robert D. White, P.O. Box 334, Newton, Ill. 62448-0334

[21] Appl. No.: 498,930

[22] Filed: Jul. 6, 1995

[51] Int. Cl.[6] ..... B63B 35/00

[52] U.S. Cl. ..... 440/12; 440/29; 440/30; 114/61

[58] Field of Search ..... 440/11, 12, 21, 440/26, 27, 29, 30, 31; 114/61, 270

[56] References Cited

U.S. PATENT DOCUMENTS

| | | | |
|---|---|---|---|
| 3,352,276 | 4/1967 | Zimmerman . | |
| 3,709,185 | 1/1973 | Hennel . | |
| 3,982,495 | 9/1976 | Hill . | |
| 4,092,945 | 6/1978 | Ankert et al. . | |
| 4,170,188 | 10/1979 | Jamieson, Jr. | 440/30 |
| 4,285,674 | 8/1981 | Chew . | |
| 4,427,392 | 1/1984 | Schneider . | |
| 5,224,886 | 7/1993 | Cunnigham . | |
| 5,362,264 | 11/1994 | Parant | 440/30 |
| 5,387,140 | 2/1995 | Cunnigham . | |
| 5,415,574 | 5/1995 | Siviero | 440/12 |

*Primary Examiner*—Stephen Avila
*Attorney, Agent, or Firm*—Jeffrey L. Streets

[57] ABSTRACT

A floatation device with propeller drive assembly and steerable rudder for use with any standard bicycle frame allowing an individual the ability to have a self propelled water craft. The device utilizes a standard bicycle, having only the wheels removed, to provide power and steering. The bicycle is mounted to the floatation device with the chain wrapped around the chain drive sprocket of the propeller drive assembly. Because the chain drive sprocket is a standard shimano sprocket, the bicycle's rear derailer may be used to shift gears. The operator may pedal the device across a body of water, then remove the bicycle frame and remount the tires to continue travel over land.

12 Claims, 7 Drawing Sheets

FLOATATION DEVICE WITH PROPELLER AND RUDDER DRIVEN BY A BICYCLE

FIELD OF THE INVENTION

The present invention relates to floatation devices designed to be propelled by pedaling. More particularly, the invention relates to a floatation device with propeller and rudder that are powered and controlled by a standard bicycle.

BACKGROUND OF THE DISCLOSURE

The development of individual pedal-powered floatation devices began at least as early as 1967, when Zimmerman (U.S. Pat. No. 3,352,276) was issued. Zimmerman discloses a pontoon boat having a seat, pedals and handlebars, each uniquely designed for use on the boat, attached in a configuration similar to a bicycle. However, the seat, pedals and handlebars were dedicated for use with the pontoon boat and could not be used with a functioning bicycle.

Hennel (U.S. Pat. No. 3,709,185) discloses an amphibious motor bike capable of operating on land and carrying the necessary equipment for travelling over water. Before travelling over water, sectionalized pontoons are taken from the side carriers to be assembled and inflated. A water paddle is mounted onto the rear wheel to be rotated thereby and thus propel the motor bike over the water. Steering is controlled by the front handlebars after a rudder swings downward into place below the front wheel. However, this water-going vessel is not very maneuverable.

Hill (U.S. Pat. No. 3,982,495) discloses a bicycle powered boat having an integrated, hydrodynamically shaped hull comprising forward and rear hull sections uniquely designed to be secured to and driven by a conventional bicycle. Both hull sections could be mounted on and carried on a rear bicycle carrier or be removed from the bicycle entirely. This device uses a rudder on the forward hull to steer. The vessel is powered by a propeller coupled to a friction roller engaging the rear bicycle wheel. However, reliance on friction for transmission of power to the propeller is less than desirable, especially when the wheel and roller will invariably get wet.

Ankert et al. (U.S. Pat. No. 4,092,945) discloses a float for attachment to the frame and axles of a standard bicycle. The bicycle pedals are provided with paddle means and the front wheel is provide with a rudder. However, the paddles provide very low power and efficiency of effort.

Chew (U.S. Pat. No. 4,285,674) discloses a float for a standard bicycle, similar to Ankert et al. above, except that the front wheel is provided with a solid circular disc to act as a rudder and the spokes of the back wheel have impeller cups or vanes attached thereto. However, this arrangement is also low in power and efficiency.

Schneider (U.S. Pat. No. 4,427,392) discloses an outboard propeller drive and steering assembly for a boat. The pedal driven system utilizes a plurality of gears, sprockets, and universal joints to provide a propeller that is steerable with a single rotating hand grip. However, the system is dedicated to use with a specially designed boat and the gear ratio is fixed.

Cunningham (U.S. Pat. No. 5,224,886) discloses a pontoon with a tubular structure to support a standard bicycle. The front wheel is removed and the front fork is attached to a support that is connected to a front rudder. The rear wheel of the bicycles rests on a rotating drum to transfer power to the drive propeller. However, the device still suffers from many of the problems mentioned above.

Cunningham (U.S. Pat. No. 5,387,140) discloses a pontoon with a tubular structure to support a standard bicycle having a combined propeller/rudder unit. The rear wheels of the bicycle rest on a rotating drum to transfer power through a flexible drive shaft to the drive propeller. The front fork is connected with an elaborate directional control system that operates to turn the apparatus in the direction of the handle bars.

Despite the above attempts to provide a bicycle powered floatation device, there remains a need for an improved device providing greater efficiency of effort, increased power and thrust, tighter steering, and a more comfortable arrangement. It would be desirable if the device would allow for the use of equipment already owned by the operator, rather than requiring the purchase of the entire unit.

SUMMARY OF THE INVENTION

The present invention provides a floatation device for use with any standard bicycle frame allowing an individual the ability to have a self propelled water craft, comprising: (a) a pair of pontoons connected by front, middle and rear crossbars, the pontoons having sufficient buoyancy to allow a standard bicycle frame and rider to maintain their balance on a surface of water; (b) a steering mechanism comprising: a steering pivot attached to the front crossbar; a steering shaft extending upward through the steering pivot comprising an upper end with a yoke for disconnectable attachment to the front forks of a standard bicycle frame and a lower end having a front bellcrank arm with a distal end; a rudder pivotally coupled to the rear crossbar comprising a rudder blade and a rear bellcrank arm with a distal end, wherein the rear bellcrank arm and the front bellcrank arm extend to opposite sides of the floatation device; a rigid steering link having a first end pivotally coupled to the distal end of the front bellcrank arm and a second end pivotally coupled to the distal end of the rear bellcrank arm so that turning the floatation device is steered in the same direction that the bicycle handlebars are turned; (c) left and right rear mounting brackets coupled to the middle crossbar for coupling with the rear axle slots of the bicycle frame, wherein the yoke assembly and the rear mounting brackets support the bicycle frame in an upright position; (d) a propeller drive assembly comprising: a transverse axle disconnectably connected to the rear mounting brackets; a drive gear assembly mounted concentrically about the axle comprising a chain sprocket cluster rigidly coupled to an upper drive belt sprocket, and first and second bearings fixed at opposite ends of the assembly and engaging the axle to allow the assembly to spin freely about the axle; a rigid, water-tight housing downwardly depending from the axle having an inner wall; a lower bearing attached to the inner wall of the housing and having a rearwardly extending axis of rotation; a propeller shaft extending through the lower bearing having a propeller attached to a first end and a lower drive belt sprocket coupled to a second end; a drive belt frictionally engaging the upper and lower drive belt sprockets; upper and lower idlers coupled to the housing wall adjacent the upper and lower drive belt sprockets respectively, wherein one of the idlers is adapted to adjust the tension on the drive belt; wherein the housing substantially encloses the upper and lower drive belt sprockets and the upper and lower idlers, and wherein the chain sprocket cluster is freely accessible for engagement with a bicycle chain so that pedaling the bicycle causes the propeller to push the floatation device forward.

DETAILED DESCRIPTION

Figure 1:
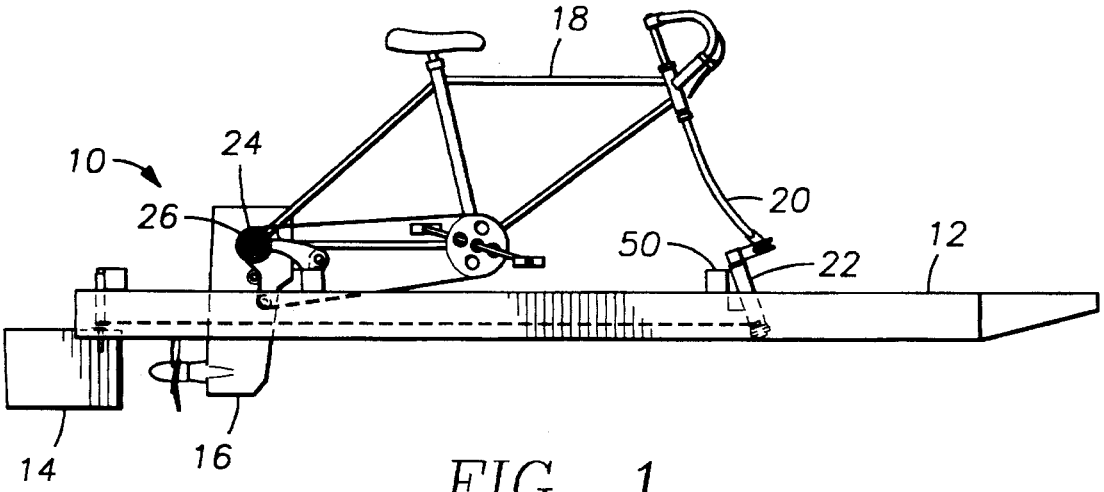
FIG. 1 is a side view of a floatation device of the present invention having a standard bicycle frame mounted thereon.

The present invention provides a floatation device for use with any standard bicycle frame allowing an individual the ability to have a self propelled water craft. Referring to FIG. 1, a floatation device 10 is shown to include a floatation device 12 having a rudder 14 and a propeller drive assembly 16. A standard bicycle frame 18 with both wheels removed has its front fork 20 coupled to a yoke 22 of a steering mechanism and its rear axle slots 24 coupled to left and right mounting brackets at point 26. Although not shown in great detail in FIG. 1, most of the bicycle frame 18 and its equipment are used to operate the floatation device. In particular, the handlebars, seat, pedals, frame and the derailers, which shift the bicycle chain from one gear to another, are all still used. The most notable parts of the bicycle 18 which are not used include the wheels and the brakes. Although the brakes are not used in accordance with the floatation device, it is important to note that the brakes are left in place, so that when the wheels of the bicycle 18 are remounted, the bicycle is ready to ride on land.

Figure 2:
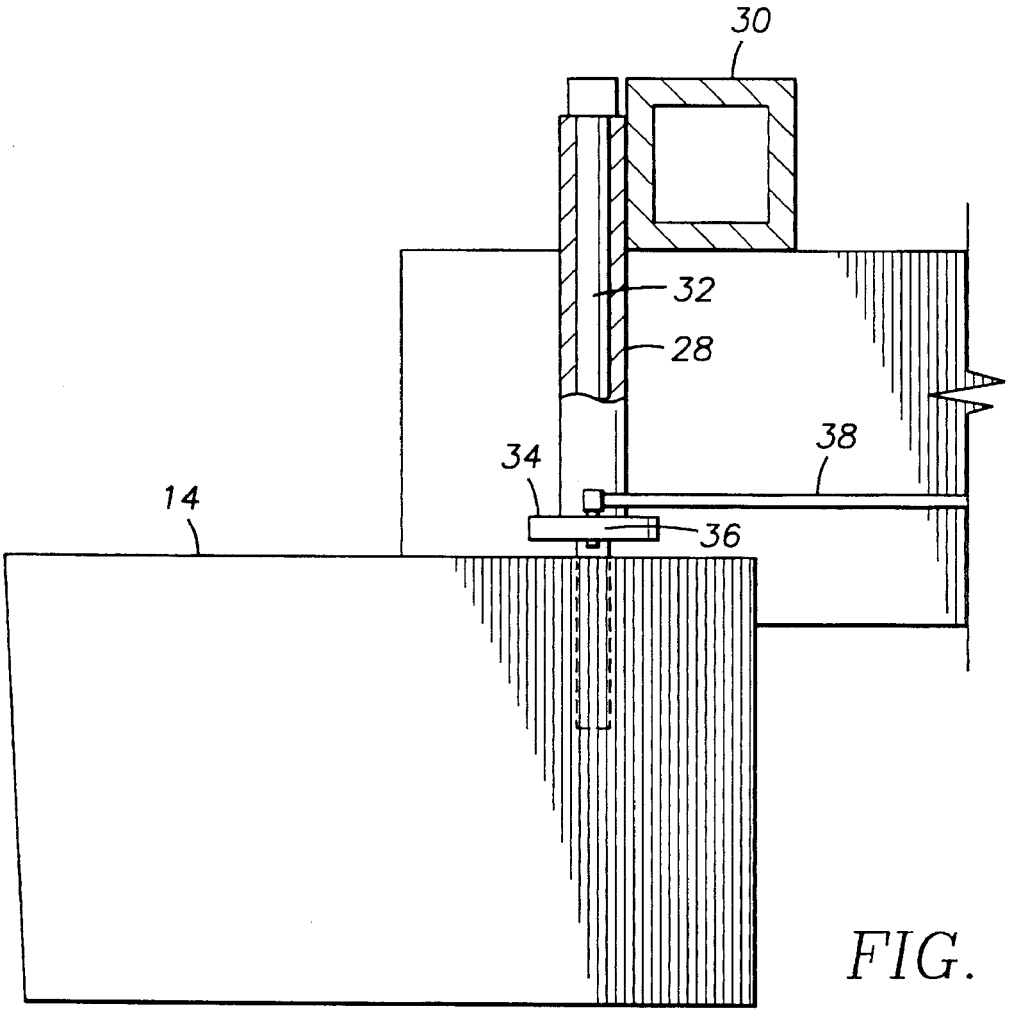
FIG. 2 is a cross-sectional side view of a rudder pivot.

Now referring to the FIG. 2, the rudder 14 of FIG. 1 is shown in greater detail. Whereas the rudder may be mounted to a wide number of structural parts, the rudder 14, and in particular the rudder pivot tube 28, is shown being mounted to a rear crossbar 30, The rudder includes a rudder pivot 32 that extends through the pivot tube 28. A bellcrank 34, attached to the rudder 14 and extending out of the page, has a distal end 36 for pivotal coupling with a steering link rod 38. Certain features just described are better shown in FIG. 3.

Figure 3:
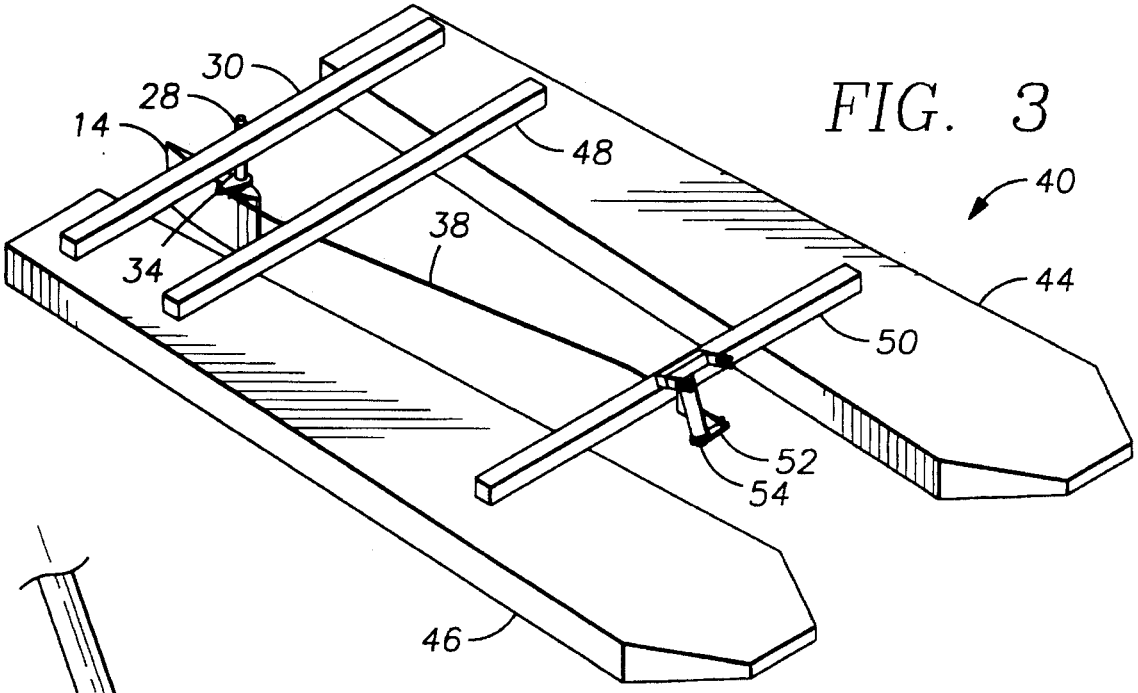
FIG. 3 is a partial plan view of a preferred embodiment having two pontoons secured together by three crossbars.

FIG. 3 is a partial plan view of a specific embodiment of the present invention where the floatation device 40 is a pair of pontoons 44,46 coupled by three crossbars 30,48,50. The figure shows the bellcrank 34 extending leftward of the rudder pivot tube 28 and being pivotally connected to the steering link rod 38. The steering link rod 38 is also connected to a bellcrank 52 connected to the lower end of a steering shaft 54.

Figure 4:
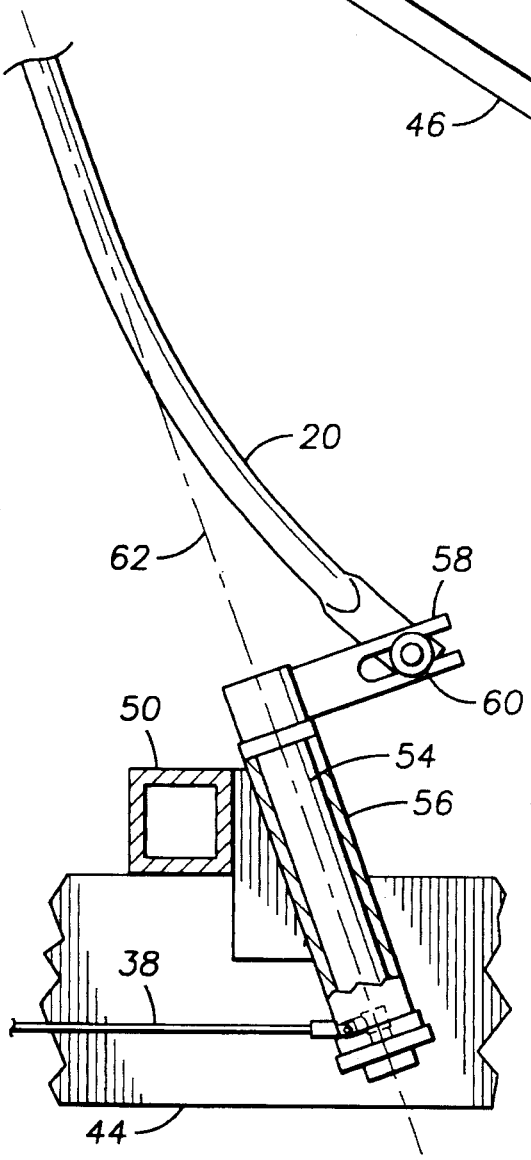
FIG. 4 is a side view of a front fork adapter.

Now referring to FIG. 4, the steering mechanism of FIG. 3 is shown more particularly. The steering shaft 54 extends upward through a steering pivot 56 that has been attached to the front crossbar 50. The upper end of the steering shaft 54 includes a yoke 58 where the front forks 20 of a bicycle can be attached using bolts 60. Note that the axis 62 should pass through the center of the front fork 20 as well as the steering pivot 56 so that the steering turns easily and supports the front of the bicycle. The yoke 58 is preferably made with a slot so that bicycles of various sizes can be attached while aligning the common axis 62.

Figure 5:
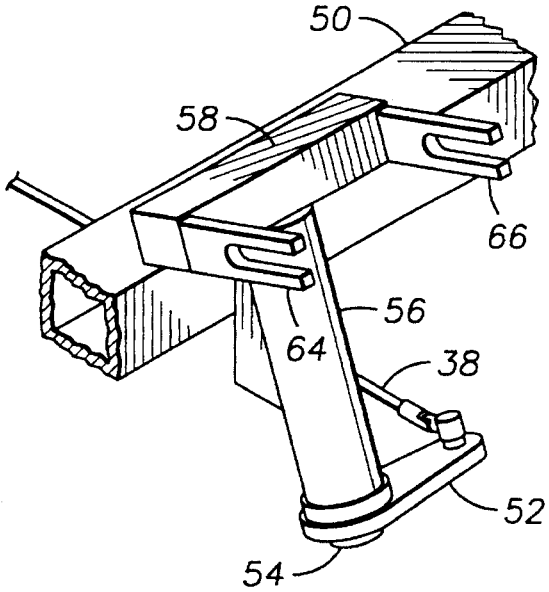
FIG. 5 is a schematic view of a front fork adapter.

The yoke 58 is shown in three dimensions in FIG. 5. The yoke 58 includes right and left prongs 64 and 66 for attachment with the front forks 20 (not shown) of the bicycle. FIG. 5 also provides a good view of the steering link rod 38 pivotally connected to bellcrank 52.

Figure 6:
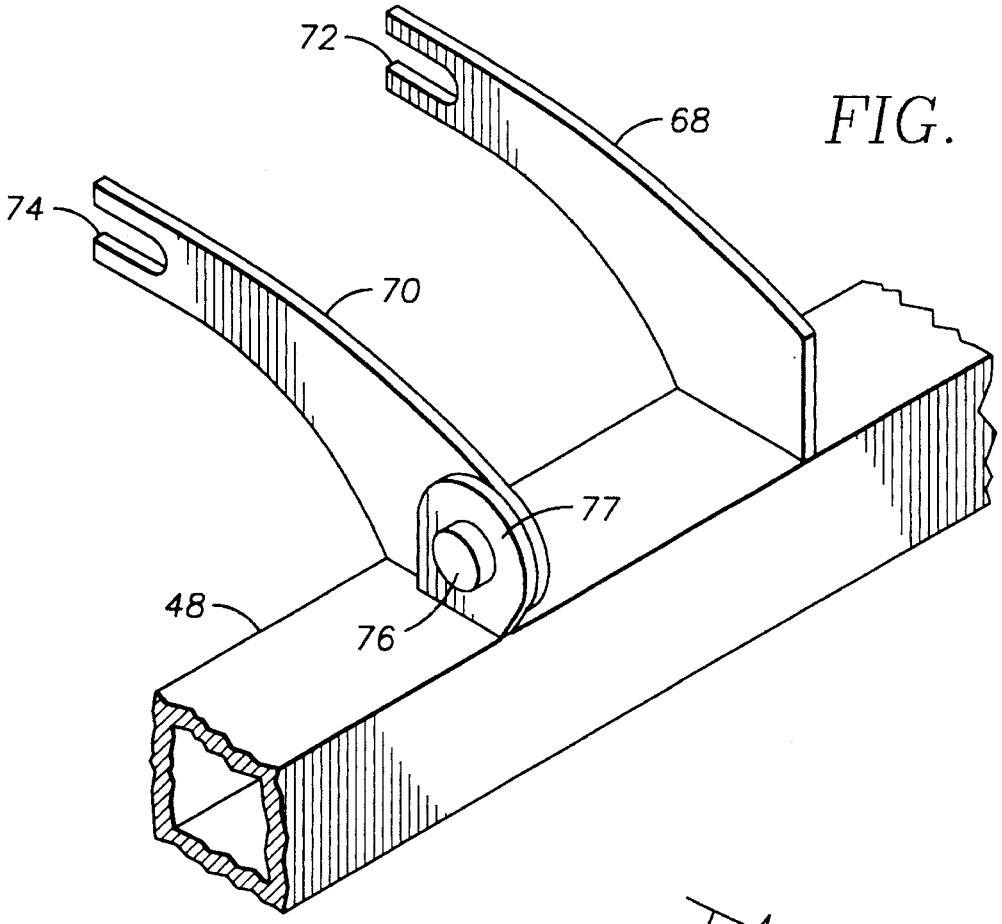
FIG. 6 is a schematic view of a right and left rear mounting bracket.

Referring now to FIG. 6, the middle crossbar 48 of FIG. 3 is shown in more detail. The crossbar 48 has two rear mounting brackets 68,70 with slots 72,74 for receiving an axle and for mounting the rear axle slots of the bicycle and the propeller drive assembly 16.

Figure 7:
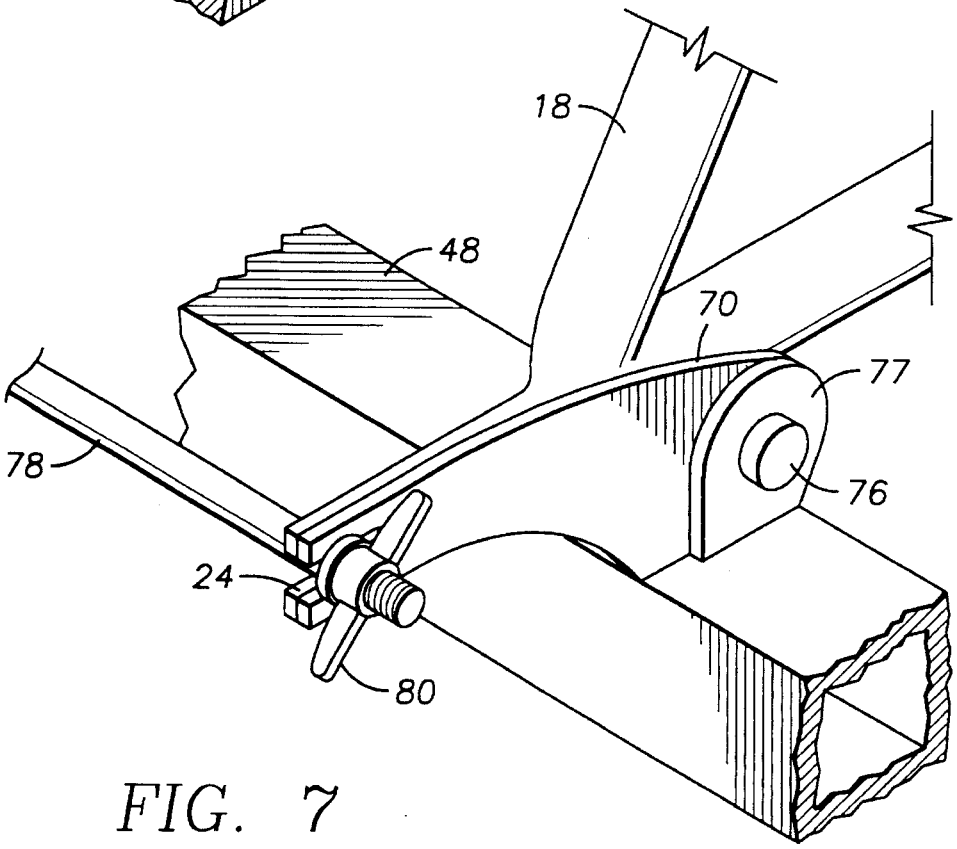
FIG. 7 is a schematic view of a pivotally coupled right rear mounting bracket.

The right rear mounting bracket 70 (as seen from the rear of the floatation device 40) is pivotally mounted at point 76 of tab 77 to the crossbar 48 so that it can swing up and out of the way to allow a bicycle chain to be placed around the propeller drive assembly 16 to be positioned between the brackets 68,70. FIG. 7 shows mounting bracket 70 having the mar axle slots 24 of a bicycle frame 18 connected thereto and an axle 78 secured in place as well by nut 80. The nut 80, as well as other frequently used nuts of the present invention, may be wing nuts or threaded knobs that can be easily and quickly hand-tightened.

Figure 8:
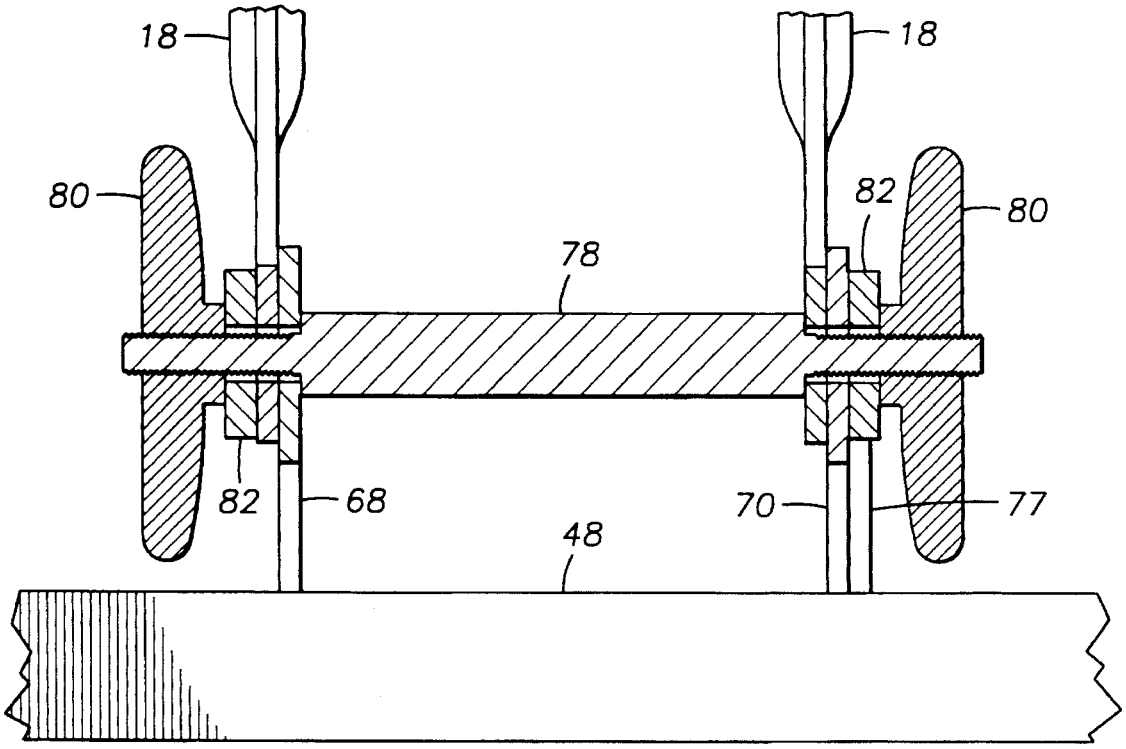
FIG. 8 is a cross-sectional rear view of an axle and bicycle frame coupled to the rear mounting brackets on the rear crossbar.

Now referring to FIG. 8, the rear mounting brackets 68 and 70 are shown in a cross-sectional view from the rear. On the left, the bicycle frame 18 is attached to the fixed rear mounting bracket 68 by the axle 78, washer 82 and threaded knob 80. The swing bracket 70 and tab 77 will be offset (as shown), but the washer 82 and threaded knob 80 will be tightened snugly in contact with the bracket 70.

Figure 9:
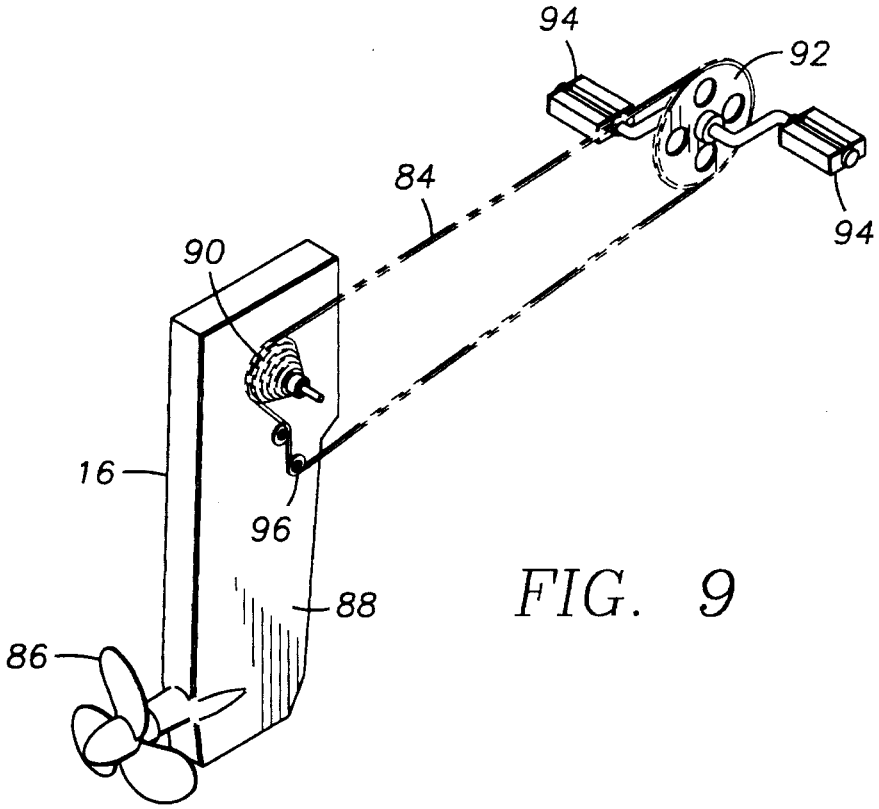
FIG. 9 is a schematic view of a propeller drive assembly connected to a bicycle chain.

FIG. 9 is a schematic view of a propeller drive assembly 16 connected to a bicycle chain 84. Note that the floatation device and bicycle frame are necessary for operation, but have been removed for purposes of illustration. The propeller drive assembly 16 has a propeller 86, a housing 88, and a drive gear assembly 90. As illustrated, the drive gear assembly is engaged by a bicycle chain 84 which is driven by a front bicycle gear 92 connected to the pedals 94. The chain 84 is kept tight and shifted from one gear to another by the rear derailer 96 which is attached to the bicycle frame (not shown).

Figure 10:
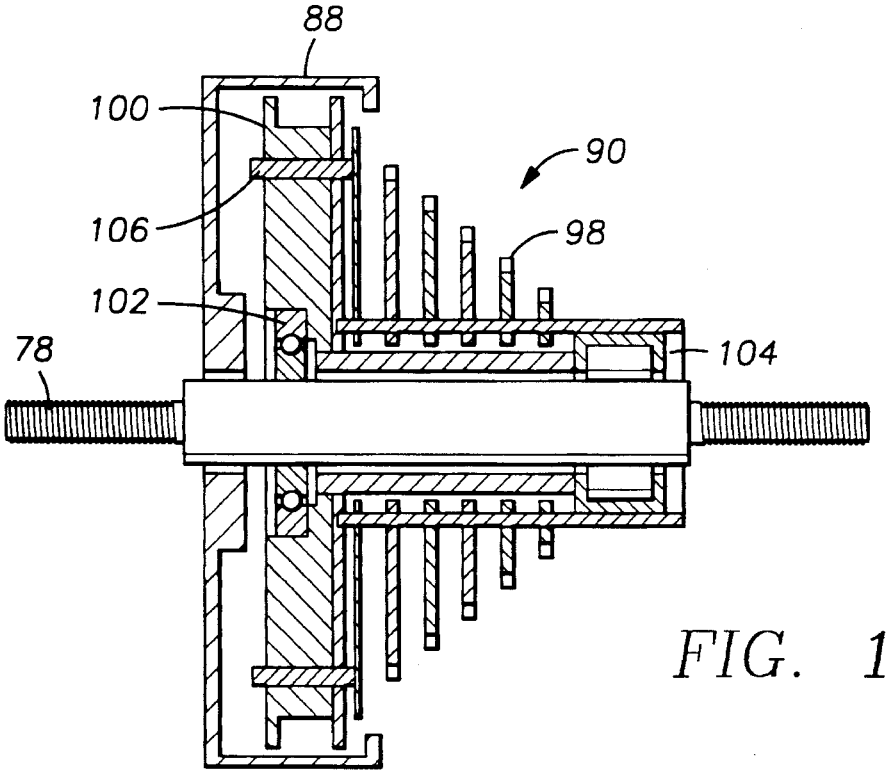
FIG. 10 is a cross-sectional rear view of a drive gear assembly and housing in position relative to the axle.

Now referring to FIG. 10, the drive gear assembly 90 is shown in place around the axle 78 and being partially enclosed by the housing 88. The drive gear assembly 90 itself comprises a chain sprocket 98 rigidly coupled to an upper drive belt sprocket 100 with first and second bearings 102,104 fixed at opposite ends of the assembly and engaging the axle 78 to allow the assembly to spin freely about the axle. While it is preferred that the drive gear assembly be molded together, the chain sprocket 98 and upper drive belt sprocket 100 may be fastened or reinforced with a screw or other suitable fastener 106.

Figure 11:
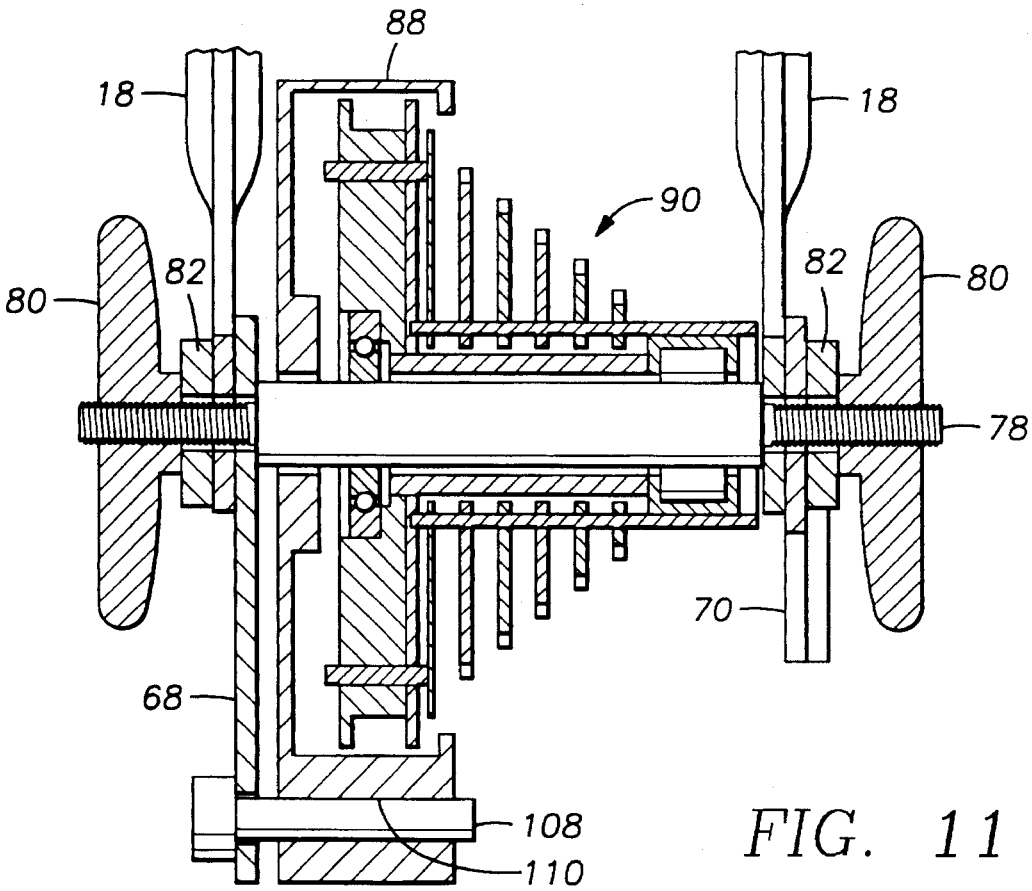
FIG. 11 is a cross-sectional rear view of the drive gear assembly and housing of FIG. 10 in positioned in the rear mounting brackets along with the bicycle frame and showing a position lock pin.

FIG. 11 shows the axle 78, housing 88, and drive gear assembly 90 of FIG. 10 mounted between the rear mounting brackets 68,70. The bicycle frame 18 straddles the drive gear assembly 90, housing 88 and the left rear mounting bracket 68 and is held together, along with the right rear mounting bracket 70, by the washers 82 and threaded knobs 80. FIG.

11 also shows a lock pin 108 which is inserted through some portion of the floatation device, illustrated here as the mounting bracket 68, and into a reinforced hole 110 in the housing 88. In this manner, the propeller drive assembly 16 can be locked into a downward position for operation or in an upward, stowing position. Alternatively, a metal bracket may be swung into position to hold the housing either up or down.

Figure 12:
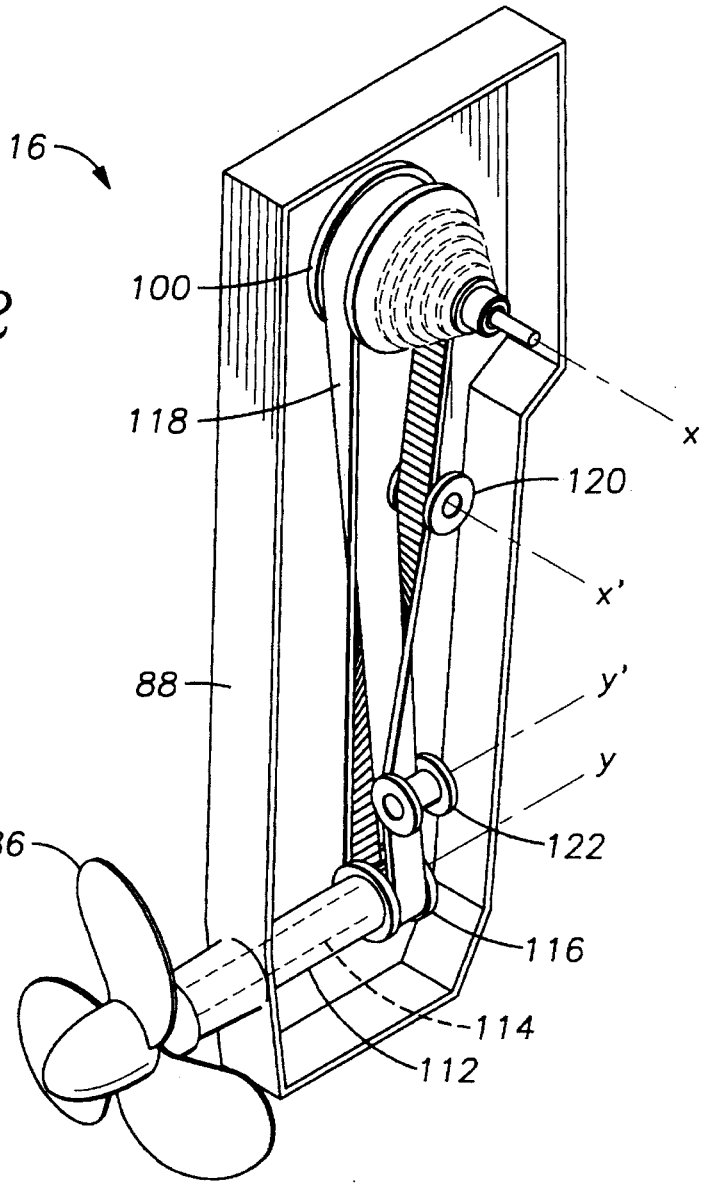
FIG. 12 is a side view of the propeller drive assembly of FIG. 9 having one side of the housing removed.
Figure 13:
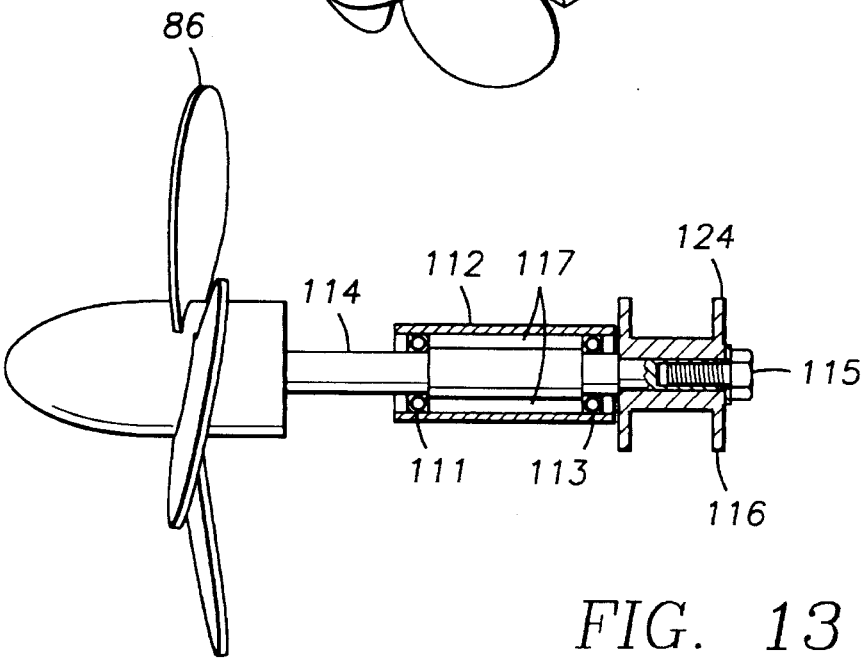
FIG. 13 is a cross-sectional view of a propeller, propeller bearing, and lower drive belt sprocket.

Now referring to FIG. 12, the propeller drive assembly 16 is illustrated with one side of the housing 88 removed. The drive gear assembly 90 is located near the top of the propeller drive assembly 16. Near the base of the housing 88 is a lower bearing assembly 112, propeller shaft 114, lower drive belt sprocket 116 and propeller 86. Referring briefly to FIG. 13, the propeller mechanism is shown in greater detail. In particular, note that the lower drive belt sprocket 116 is attached to the end of the propeller shaft 114 with a bolt 115. The lower bearing assembly 112 is made up of two bearings 111 and 113 and is filled with packing 115 such as greased rope. Referring back to FIG. 12, a heavy torque drive (HTD) cog belt 118 is wrapped over the upper belt drive sprocket 100 and around the lower belt drive sprocket 116. The HTD cog belt 118 is held firmly around both drive sprockets by upper and lower idlers 120,122. It is preferred that one of the idlers, particularly the upper idler, be adjustable to maintain proper tension on the belt 118. It is very important to note that the drive gear assembly 90 and upper idler 120 rotate or spin around the axis labeled "x" and "$x^1$" and the lower drive belt sprocket 116 and lower idler 122 rotate or spin around the axis labeled "y" and "$y^1$". Because the "x" and "$x^1$" axis are perpendicular (a 90 degree angle) to the "y" and "$y^1$" axis, the belt 118 must be twisted the same 90 degrees. In order to operate the twisted belt without it jumping off track, it is preferred that the drive belt sprockets 100,116 and idlers 120,122 have wide flanges (see FIG. 13 at point 124 for example) to guide the belt. This is particularly important for the smaller diameter sprocket 116 and the idlers.

Figure 14:
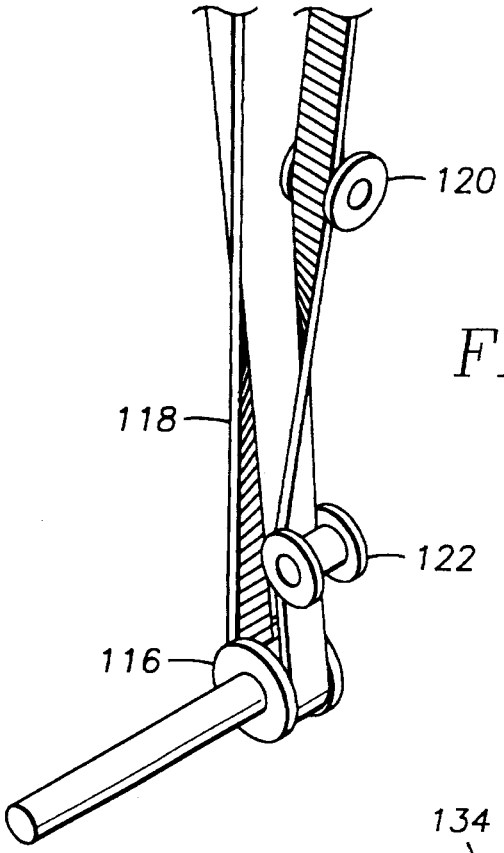
FIG. 14 is an exploded plan view showing the relative positioning of the lower drive belt sprocket to the lower idler and drive belt.
Figure 15:
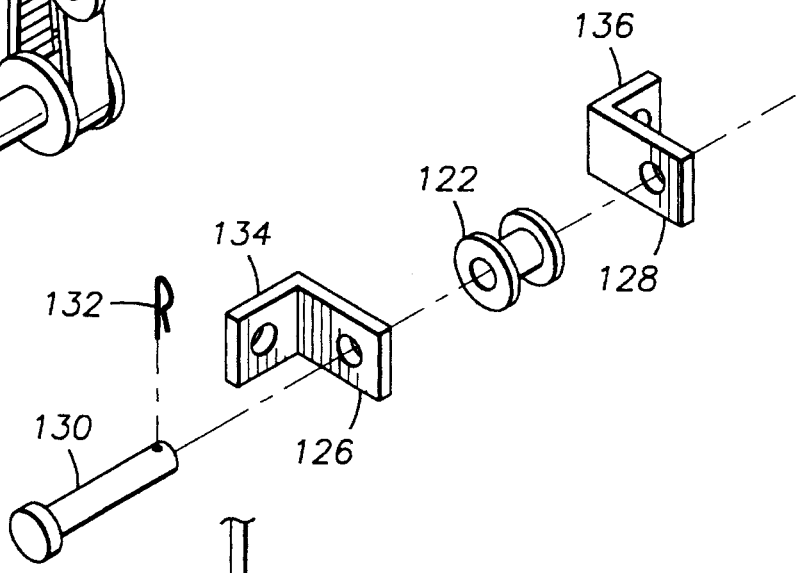
FIG. 15 is an exploded plan view of the lower idler.

FIG. 14 illustrates how the belt 118 wraps around the lower drive belt sprocket 116. The belt 118 may pass either over or under the lower idler 122, but is preferably passed over. FIG. 15 illustrates how the lower idler 122 is assembled using two angle irons 126,128 and a pin 130 and clasp 132. It is preferred that the base surfaces 134, 136 of the angle irons 126,128 be permanently secured to the wall of the housing 88. While the irons may be secured by any known technique, it is preferred that the irons be secured by using fiberglass and resin.

Figure 16:
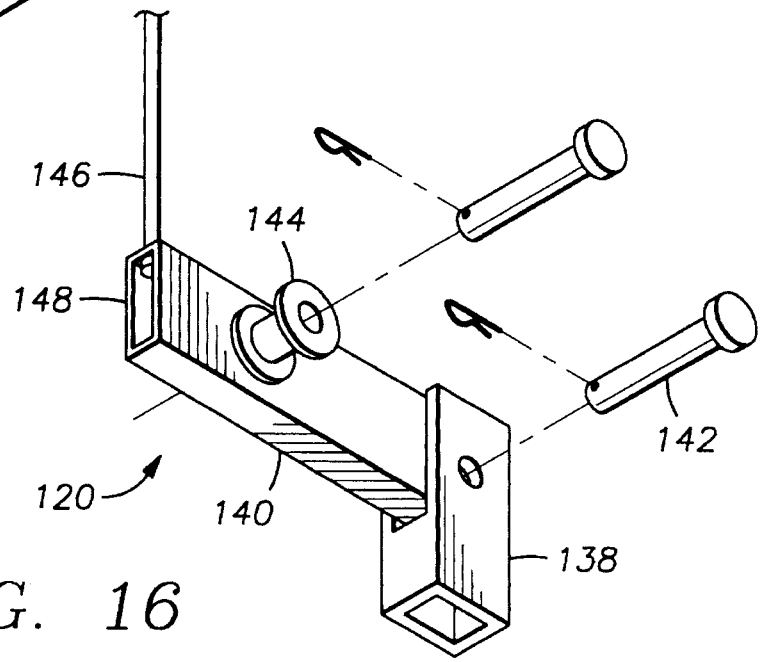
FIG. 16 is an bottom plan view of the upper idler.

Finally, referring now to FIG. 16, a bottom view of the upper idler 120 is shown to be an adjustable idler. The idler 120 is comprised of a stationary base 138 affixed to the wall of the housing 88, a swing arm 140 connected to the base 138 by a pivot pin or bolt 142, the idler pulley 144 mounted on the swing arm, and the tension rod 146 extending from the distal end 148 of the swing arm 140. The tension rod extends through the housing and is adjustably secured. The preferred tension rod has a externally threaded end which cooperates with an internally threaded knob or nut. As the knob or nut is tightened, the rod is pulled upward to increase the tension of the belt. Similarly, loosening the knob or nut cause a decrease in the belt tension.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiment, the scope thereof is determined by the claims which follow:

What is claimed is:

1. A floatation device for use with any standard bicycle frame allowing an individual the ability to have a self propelled water craft, comprising:

(a) floatation means having sufficient buoyancy to allow a standard bicycle frame and rider to maintain their balance on a surface of water;

(b) a steering mechanism having a yoke assembly adapted for coupling with the front fork of a bicycle frame;

(c) left and right rear mounting brackets extending upward from the floatation device for coupling with the rear axle slots of the bicycle frame, wherein the yoke assembly and the rear mounting brackets support the bicycle frame in an upright position;

(d) a propeller drive assembly comprising (1) a transverse axle disconnectably connected to the rear mounting brackets;

(2) a drive gear assembly mounted concentrically about the axle comprising a chain sprocket rigidly coupled to an upper drive belt sprocket, and first and second bearings fixed at opposite ends of the assembly and engaging the axle to allow the assembly to spin freely about the axle;

(3) a rigid, water-tight housing downwardly depending from the axle having an inner wall;

(4) a lower bearing attached to the inner wall of the housing and having a rearwardly extending axis of rotation;

(5) a propeller shaft extending through the lower bearing having a propeller attached to a first end and a lower drive belt sprocket coupled to a second end;

(6) a drive belt frictionally engaging the upper and lower drive belt sprockets;

(7) upper and lower idlers coupled to the housing wall adjacent the upper and lower drive belt sprockets respectively, wherein one of the idlers is adapted to adjust the tension on the drive belt;

(8) wherein the housing substantially encloses the upper and lower drive belt sprockets and the upper and lower idlers, and wherein the chain sprocket cluster is freely accessible for engagement with a bicycle chain so that pedaling the bicycle causes the propeller to push the floatation device forward.

2. The floatation device of claim 1 wherein the bicycle frame has a rear derailer, and wherein the drive gear assembly comprises a plurality of chain sprockets in the form of a standard multi-speed shimano chain sprocket so that the ratio of propeller turns to pedal turns can be changed by activating the rear derailer.

3. The floatation device of claim 2 wherein the bicycle frame further includes a front derailer and pedal multi-speed shimano chain sprocket, and wherein the ratio of propeller turns to pedal turns can be changed by activating the front derailer.

4. The floatation device of claim I wherein the housing may pivot about the axle between an up position for stowing and a down position for propelling the floatation device.

5. The floatation device of claim I wherein the steering mechanism comprises:

a steering pivot attached to the forward portion of the floatation means;

a steering shaft extending upward through the steering pivot comprising an upper end with a yoke for disconnectable attachment to the front forks of a standard bicycle frame and a lower end having a front bellcrank arm with a distal end;

a rudder pivotally coupled to the floatation means rearward of the propeller comprising a rear bellcrank arm with a distal end, wherein the rear bellcrank arm and the front bellcrank arm extend to opposite sides of the floatation device;

a rigid steering link having a first end pivotally coupled to the distal end of the front bellcrank arm and a second end pivotally coupled to the distal end of the rear bellcrank arm so that turning the floatation device is steered in the same direction that the bicycle handlebars are turned.

6. A floatation device for use with any standard bicycle frame allowing an individual the ability to have a self propelled water craft, comprising:

(a) a pair of pontoons connected by front, middle and rear crossbars, the pontoons having sufficient buoyancy to allow a standard bicycle frame and rider to maintain their balance on a surface of water;

(b) a steering mechanism comprising:

(1) a steering pivot attached to the front crossbar;

(2) a steering shaft extending upward through the steering pivot comprising an upper end with a yoke for disconnectable attachment to the front forks of a standard bicycle frame and a lower end having a front bellcrank arm with a distal end;

(3) a rudder pivotally coupled to the rear crossbar comprising a rudder blade and a rear bellcrank arm with a distal end, wherein the rear bellcrank arm and the front bellcrank arm extend to opposite sides of the floatation device;

(4) a rigid steering link having a first end pivotally coupled to the distal end of the front bellcrank arm and a second end pivotally coupled to the distal end of the rear bellcrank arm so that turning the floatation device is steered in the same direction that the bicycle handlebars are turned;

(c) left and right rear mounting brackets coupled to the middle crossbar for coupling with the rear axle slots of the bicycle frame, wherein the yoke assembly and the rear mounting brackets support the bicycle frame in an upright position;

(d) a propeller drive assembly comprising (1) a transverse axle disconnectably connected to the rear mounting brackets;

(2) a drive gear assembly mounted concentrically about the axle comprising a chain sprocket cluster rigidly coupled to an upper drive belt sprocket, and first and second bearings fixed at opposite ends of the assembly and engaging the axle to allow the assembly to spin freely about the axle;

(3) a rigid, water-tight housing downwardly depending from the axle having an inner wall;

(4) a lower bearing attached to the inner wall of the housing and having a rearwardly extending axis of rotation;

(5) a propeller shaft extending through the lower bearing having a propeller attached to a first end and a lower drive belt sprocket coupled to a second end;

(6) a drive belt frictionally engaging the upper and lower drive belt sprockets;

(7) upper and lower idlers coupled to the housing wall adjacent the upper and lower drive belt sprockets respectively, wherein one of the idlers is adapted to adjust the tension on the drive belt;

(8) wherein the housing substantially encloses the upper and lower drive belt sprockets and the upper and lower idlers, and wherein the chain sprocket cluster is freely accessible for engagement with a bicycle chain so that pedaling the Bicycle causes the propeller to push the floatation device forward.

7. The floatation device of claim 6 wherein the rudder is mounted at the same depth below the pontoons as is the propeller and directly behind the propeller.

8. The floatation device of claim 7 wherein the rudder has substantially flat surface area and further comprises a pivot shaft defining a point about which the rudder pivots, and wherein about 25 percent of the rudder surface area is forward of the rudder pivot point.

9. The floatation device of claim 6 wherein the left and right rear mounting brackets each have a substantially horizontal slot cut therein to allow bicycles frames of various sizes to be attached thereto.

10. The floatation device of claim 6 wherein the right rear mounting bracket is configured to avoid contact with the rear derailer on the bicycle frame.

11. The floatation device of claim 10 wherein the right rear mounting bracket is pivotally coupled to the middle crossbar so that the right rear mounting bracket can be pivoted away from the axle to allow the bicycle chain to be placed around the chain sprocket.

12. A propeller drive assembly for propelling a floatation device over a body of water using a standard bicycle chain, the propeller drive assembly comprising (1) a transverse axle disconnectably connected to the rear mounting brackets;

(2) a drive gear assembly mounted concentrically about the axle comprising a chain sprocket cluster rigidly coupled to an upper drive belt sprocket, and first and second bearings fixed at opposite ends of the assembly and engaging the axle to allow the assembly to spin freely about the axle;

(3) a rigid, water-tight housing downwardly depending from the axle having an inner wall;

(4) a lower bearing attached to the inner wall of the housing and having a rearwardly extending axis of rotation;

(5) a propeller shaft extending through the lower bearing having a propeller attached to a first end and a lower drive belt sprocket coupled to a second end;

(6) a drive belt frictionally engaging the upper and lower drive belt sprockets;

(7) upper and lower idlers coupled to the housing wall adjacent the upper and lower drive belt sprockets respectively, wherein one of the idlers is adapted to adjust the tension on the drive belt;

(8) wherein the housing substantially encloses the upper and lower drive belt sprockets and the upper and lower idlers, and wherein the chain sprocket cluster is freely accessible for engagement with a bicycle chain so that pedaling the bicycle causes the propeller to push the floatation device forward.

* * * * *